US006805756B2

(12) United States Patent
Claffey et al.

(10) Patent No.: US 6,805,756 B2
(45) Date of Patent: Oct. 19, 2004

(54) UNIVERSAL AQUEOUS COATING COMPOSITIONS FOR PRETREATING METAL SURFACES

(75) Inventors: William J. Claffey, Novelty, OH (US); John F. McIntyre, Bay Village, OH (US); Leslie M. Beck, Concord, OH (US)

(73) Assignee: PPG Industries Ohio, Inc., Cleveland, OH (US)

( * ) Notice: Subject to any disclaimer, the term of this patent is extended or adjusted under 35 U.S.C. 154(b) by 102 days.

(21) Appl. No.: 10/153,022

(22) Filed: May 22, 2002

(65) Prior Publication Data

US 2003/0221751 A1 Dec. 4, 2003

(51) Int. Cl.[7] ..... C23C 22/07; C09D 5/08; C23F 11/167

(52) U.S. Cl. ..... 148/259; 148/260; 106/14.12; 252/389.2

(58) Field of Search ..... 178/243, 253, 178/259, 260; 106/14.12; 252/389.2, 393, 394

(56) References Cited

U.S. PATENT DOCUMENTS

| | | | | |
|---|---|---|---|---|
| 3,695,942 | A | 10/1972 | Binns | 148/6.15 R |
| 4,148,670 | A | 4/1979 | Kelly | 148/6.15 R |
| 4,293,349 | A | 10/1981 | Pedrazzini | 148/6.15 |
| 4,338,140 | A | 7/1982 | Reghi | 148/6.14 R |
| 4,457,790 | A | 7/1984 | Lindert et al. | 148/6.15 R |
| 4,470,853 | A | 9/1984 | Das et al. | 148/6.15 Z |
| 5,011,551 | A | 4/1991 | Emeric et al. | 148/248 |
| 5,125,989 | A | 6/1992 | Hallman | 148/247 |
| 5,380,374 | A | 1/1995 | Tomlinson | 148/247 |
| 5,656,070 | A | 8/1997 | Clough | 106/14.41 |
| 5,662,746 | A | 9/1997 | Affinito | 148/247 |
| 5,771,996 | A | 6/1998 | Marasco | 188/112 R |
| 5,868,820 | A | 2/1999 | Claffey | 106/14.44 |

FOREIGN PATENT DOCUMENTS

| | | | |
|---|---|---|---|
| GB | 2 259 920 A | 3/1993 | C23C/22/42 |

OTHER PUBLICATIONS

Cape, Thomas, "Phosphate Conversion Coatings", ASM Handbook, Formerly Ninth Edition, Metals Handbook, vol. 13: Corrosion, ASM International Handbook Committee, 1992, pp. 383–388.*

* cited by examiner

*Primary Examiner*—George Wyszomierski
*Assistant Examiner*—Harry D Wilkins, III
(74) *Attorney, Agent, or Firm*—William J. Uhl

(57) ABSTRACT

A universal aqueous composition and a process for using such a composition for pretreating metal substrates is provided. The aqueous composition includes a hydroxy functional cyclic compound, such as a tannin, in an amount of at least about 500 ppm, phosphate ions, an oxidizer-accelerator, and at least one Group IVB metal compound capable of converting to a metal oxide upon application to the metal substrate, such as a fluorozirconate or fluorotitanate. The composition may further contain fluoride ions and/or iron. The composition is particularly useful for corrosion resistance with a variety of metals such as iron, steel, zinc-coated surfaces, aluminum, and alloys thereof. A disaccharide may further be provided to prolong the useful life of the composition, particularly when used in spray applications.

24 Claims, No Drawings

UNIVERSAL AQUEOUS COATING COMPOSITIONS FOR PRETREATING METAL SURFACES

FIELD OF THE INVENTION

The present invention relates to coating compositions for pretreating metal surfaces. More particularly, the present invention is directed to aqueous coating compositions for providing durable, adhesive and corrosion-inhibiting coatings, as well as a method for pretreating metal substrates with such coating compositions.

BACKGROUND OF THE INVENTION

Pretreatment of metal surfaces such as aluminum, ferrous and zinc surfaces with inorganic phosphate compositions and/or coatings by contacting such surfaces with an aqueous phosphating solution is well known. Such phosphate pretreatment processes protect the metal surface to a limited extent against corrosion, and serve as an effective base for the later application of organic coating compositions such as paint, lacquer, varnish, primer, synthetic resin, enamel, and the like.

Inorganic phosphate coatings generally are formed on a metal surface by means of an aqueous solution which contains phosphate ion and, optionally, certain auxiliary ions including metallic ions such as iron, sodium, manganese, zinc, cadmium, copper, lead, calcium-zinc, cobalt, nickel and antimony ions. These aqueous solutions also may contain non-metallic ions such as halide ions, nitrate ions, sulfate ions and borate ions. Recent advances in the pretreatment field have been directed to coatings derived from solutions containing a minimum of three metal cations such as zinc, cobalt, nickel, manganese, magnesium or calcium.

Chromium-free compositions have been proposed as rinse compositions for improving the quality of coated metal substrates. For example, U.S. Pat. No. 3,695,942 discloses a zirconium rinse for use with metal surfaces which have been pretreated with a phosphate conversion coating.

Aqueous pretreatment processes with coating compositions including an organic compound such as tannin, phosphate ions and an oxidizing agent are taught through U.S. Pat. No. 5,868,820. Such pretreatment processes and compositions typically require immersion or deposition of the coating composition at temperatures of 120° F. Chromium-free compositions and titanium and zirconium compositions are disclosed as rinse compositions for application over the first coating composition. Such pretreatment processes and compositions involve multiple coatings in order to provide satisfactory results over a variety of different metal substrates.

U.S. Pat. No. 4,338,140 discloses coating compositions for improving corrosion resistance over metal surfaces such as aluminum cans, which includes dissolved hafnium and/or zirconium, fluoride, up to about 500 parts per million of a vegetable tannin compound, and optionally phosphate ions.

While prior art pretreatment processes can be effective, they typically require processing conditions involving elevated temperatures, and are typically useful for only selected metal substrates Accordingly, there is a need for a pretreatment process which can be conducted at ambient conditions and which can provide effective properties for a variety of substrate materials.

SUMMARY OF THE INVENTION

The present invention includes an aqueous composition for pretreating metal substrates. The aqueous composition includes at least one hydroxy functional cyclic compound present in an amount of at least about 500 ppm, with the hydroxy functional cyclic compound being selected from the group consisting of hydroxy phenolic compounds and heterocyclic nitrogen-containing compounds having polyhydroxy functionality, such as a tannin, for example quebracho and/or mimosa tannins. The aqueous composition further includes phosphate ions, at least one oxidizer-accelerator, at least one Group IVB metal compound capable of converting to a metal oxide upon application to the metal substrate, and water. The Group IVB metal compound is preferably selected from the group consisting of hexafluorozirconic acid and hexafluorotitanic acid and their soluble salts.

The composition of the present invention may further include at least one disaccharide, such as those selected from the group consisting of lactose and sucrose.

The present invention further relates to a process for pretreating a metal substrate. The process includes contacting the substrate with an aqueous composition which includes at least one hydroxy functional cyclic compound present in an amount of at least about 500 ppm; phosphate ions; at least one oxidizer-accelerator; at least one Group IVB metal compound capable of converting to a metal oxide upon application to the metal substrate; and water. The process is particularly useful for improving corrosion resistance of a variety of substrates, including cold rolled steel, steel surfaces treated with any of zinc metal, zinc compounds and zinc alloys; aluminum; aluminum alloys; zinc-aluminum alloys; aluminum plated steel; and aluminum alloy plated steel. The process includes contacting the metal substrate with the aqueous composition, for example by immersion or by spray application. The process may further include a rinsing step, such as by rinsing the metal substrate with an aqueous solution containing silane or an epoxy derivative after contact with the aqueous composition.

DETAILED DESCRIPTION OF THE INVENTION

Other than in the operating examples, or where otherwise indicated, all numbers expressing quantities of ingredients, reaction conditions and so forth used in the specification and claims are to be understood as being modified in all instances by the term "about." Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical values, however, inherently contain certain errors necessarily resulting from the standard deviation found in their respective testing measurements.

Also, it should be understood that any numerical range recited herein is intended to include all sub-ranges subsumed therein. For example, a range of "1 to 10" is intended to include all sub-ranges between (and including) the recited minimum value of 1 and the recited maximum value of 10, that is, having a minimum value equal to or greater than 1 and a maximum value of equal to or less than 10.

As indicated, the present invention is directed to aqueous compositions for pretreating metal substrates. The compositions of the present invention may be utilized to improve the corrosion-inhibiting properties of metal surfaces such as iron, steel, and zinc-coated surfaces. The coatings deposited by the compositions of the present invention can be used to replace non-reactive inorganic metal treatments such as iron phosphate, zinc phosphate and chromium conversion coatings.

In one embodiment of the invention, the aqueous coating composition includes at least one polyhydroxy functional cyclic compound selected from the group consisting of polyhydroxy phenolic compounds and heterocyclic nitrogen-containing compounds having polyhydroxy functionality, phosphate ions, and an oxidizer-accelerator. In addition, the coating composition includes at least one Group IVB metal compound capable of converting to a metal oxide upon application to the metal substrate.

The cyclic hydroxy compound is selected from cyclic polyhydroxy compounds and substituted phenols. A variety of cyclic hydroxy compounds can be utilized in the present invention and these include phenolic compounds such as catechol, methylene-bridged poly(alkylphenols), coumaryl alcohol, coniferyl alcohol, sinapyl alcohol, lignin and tannic acid, or non-phenolic compounds such as ascorbic acid, hydroxy alkyl celluloses such as hydroxy methyl cellulose, hydroxy ethyl cellulose and hydroxy propyl cellulose, and heterocyclic nitrogen containing compounds also containing polyhydroxy functionality such as glycolurilformaldehyde amino resin having the general structure

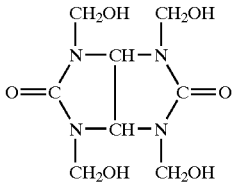

In the cyclic hydroxy compounds, at least one hydroxy group is attached directly to a ring and another hydroxy group may be on an aliphatic group (e.g., —$CH_2OH$) attached to the ring.

Tannin or tannic acid is a polyphenolic substance which is a preferred example of the cyclic polyhydroxy compounds which are useful in the aqueous coating compositions of the present invention. Tannins are polyphenolic compounds which are extracted from various plants and trees, which can be classified according to their chemical properties as (a) hydrolyzable tannins; (b) condensed tannins; and (c) mixed tannins containing both hydrolyzable and condensed tannins. Preferred tannin materials useful in the present invention are those that contain a tannin extract from naturally occurring plants and trees, and are normally referred to as vegetable tannins. Suitable vegetable tannins include the crude, ordinary or hot-water-soluble condensed, vegetable tannins. Quebracho and mimosa are preferred condensed vegetable tannins. Other vegetable tannins include mangrove, spruce, hemlock, gabien, wattles, catechu, uranday, tea, larch, myrobalan, chestnut wood, divi-divi, valonia, summac, chinchona, oak, etc. These vegetable tannins are not pure chemical compounds with known structures, but rather contain numerous components including phenolic moieties such as catechol, pyrogallol, etc., condensed into a complicated polymeric structure.

The cyclic hydroxy compounds utilized in the coating compositions of the present invention also may be substituted phenolic compounds containing only one hydroxyl group. The substituents on the phenolic compounds may be alkyl, hydroxyalkyl, or alkoxy groups containing from 1 to about 6 or more carbon atoms Specific examples of alkyl groups include methyl, ethyl, propyl, isopropyl, n-butyl, sec-butyl, tert-butyl, amyl, etc. Examples of alkoxy groups include methoxy, ethoxy, propoxy, etc. In one preferred embodiment, the phenolic compounds will be substituted with two or more alkyl or alkoxy groups. Examples of substituted phenols useful in the coating compositions of the present invention include 4-hydroxybenzyl alcohol, 2,6-dimethylphenol, 2,6-di-tert-butylphenol, 2,6-di-t-butyl-p-cresol, etc.

The aqueous compositions of the present invention preferably contains at least about 500 ppm of the cyclic polyhydroxy compound described above. More preferably, the aqueous compositions of the present invention contains from about 500 ppm to about 2,500 ppm of the cyclic polyhydroxy compound, and in particularly desirable applications, about 1,500 ppm of the cyclic polyhydroxy compound. Incorporating the cyclic polyhydroxy compound, and in particular tannin, at such high levels, provides the coating composition with excellent adhesion to a variety of substrate materials, including steel, zinc-coated steel and aluminum.

In an alternate embodiment of the invention, the cyclic polyhydroxy compound is reacted with a further organic compound. As such, derivative compounds, such as derivatives of native tannins, can be prepared and used in the compositions of the present invention. For example, phenyl glycidyl ether can be reacted with mimosa tannin with a ratio of one mole of tannin hydroxy groups to a half mole of epoxy.

The aqueous coating composition of the present invention also contains phosphate ions. In one particular embodiment, the coating composition contains from about 10 to about 500 ppm of phosphate ions, more preferably from about 125 to 300 ppm. The source of the phosphate ions in the aqueous coating composition of the present invention is typically phosphoric acid such as 75% phosphoric acid, although other sources are contemplated by the present invention.

An alkali metal hydroxide such as sodium hydroxide or potassium hydroxide may be added to the aqueous coating composition of the present invention in an amount sufficient to convert the phosphoric acid to an alkali metal phosphate such as sodium phosphate or potassium phosphate. Additionally, an amine hydroxide (ammonium hydroxide) may be added to convert phosphoric acid to ammonium phosphate. Other phosphate sources include sodium acid pyrophosphate, potassium acid pyrophosphate, polyphosphates and combinations thereof.

The aqueous coating compositions also contain at least one oxidizer-accelerator which increases the rate of deposition of the coating. The oxidizer-accelerators useful in the present invention may be inorganic or organic accelerators. Examples of inorganic oxidizer-accelerators include alkali metal and ammonium chlorates, bromates, perchlorates, chlorites, nitrates, nitrites, molybdates, perborates, or mixtures thereof. Dilute solutions of hydrogen peroxide also are effective as oxidizers-accelerators in the coating compositions. Alternatively, high volume air sparging of the coating composition, is effective as an oxidizer-accelerator when the composition is in contact with the metal surface. Examples of organic oxidizer-accelerators include nitroguanidine, halo- or nitro-substituted benzene sulfonic acids and the alkali metal and ammonium salts of said sulfonic acids. Alkali metal salts of nitro-substituted benzene sulfonic acids, and more particularly, metanitrobenzene sulfonic acid are particularly useful oxidizer-accelerators, particularly in combination with one or more of the inorganic accelerators such as the alkali metal chlorates and nitrates. Thus, a particularly useful oxidizer-accelerator comprises the mixture of at least one alkali metal chlorate or nitrate and sodium meta-nitrobenzene sulfonate. The amount of oxidizer-accelerator included in the coating compositions may vary over a wide range. Generally, the coating compositions will contain from about 0.01 to about 3% by weight based on the total weight of the composition of at least one oxidizer-accelerator, although amounts of up to about 1.5% by weight provide satisfactory results.

The composition of the present invention further comprises at least one metal compound which is capable of converting to a metal oxide upon application to the metal substrate. The metal compound which is the precursor of the formation of the metal oxide on the surface of the substrate can be any metal compound capable of converting to a metal oxide. The metal compound is preferably selected from the Group IVB metals, most preferably zirconium or titanium. Incorporation of the metal compound with the cyclic compound, the phosphate ions and the oxidizer-accelerator in the pretreatment composition provides a synergistic effect, which improves adhesion of subsequently applied top coats, and permits treatment at ambient temperature. While not wishing to be bound by any particular theory, it is believed that the pretreatment composition allows for co-deposition of a metal oxide from the metal compound, as well as the cyclic compound and phosphate ions. Such co-deposition provides a synergistic effect for pretreatment of metal substrates.

As indicated, the metal compound is selected from the Group IVB transition metals of the Periodic Table of the Elements, such as those selected from the group consisting of titanium, zirconium and hafnium ions and mixtures thereof. The Group IVB metal, and in particular zirconium, is provided in ionic form, which is easily dissolved in the aqueous composition. The metal ions may be provided by the addition of specific compounds of the metals, such as their soluble acids and salts, including, for example, nitrate, sulfate, fluoride, acetate, citrate and/or chloride salts, and mixtures and combinations thereof Soluble alkali metal salts are particularly desirable. Examples of useful compositions include fluorozirconic acid, fluorotitanic acid, ammonium and alkali metal fluorozirconates and fluorotitanates, zirconium fluoride, zirconium nitrate, zirconium sulfate, and the like. Hexafluorozirconic acid and hexafluorotitanic acid and their soluble salts are particularly preferred. Examples of other particularly useful compounds include fluorotitanates and fluorozirconates having coordination numbers from 4 to 7, such as heptafluorozirconate, hexafluorozirconate, pentafluorozirconate, and tetrafluorozirconate.

The metal compound is preferably present in the solution of the present invention in an amount of from about 60 ppm to about 350 ppm.

As indicated, the coating compositions of the present invention are provided as an aqueous solution. The balance of the composition, therefore comprises water.

In addition, the aqueous coating compositions of the present invention may also contain ferrous or ferric ions in amounts of up to about 250 to 2,000 ppm. When the aqueous coating compositions of the present invention are to be utilized to coat non-ferrous surfaces such as zinc-coated surfaces, ferrous or ferric ions are added to the coating composition. Water-soluble forms of iron can be utilized as a source of the ferrous or ferric ions, and such compounds include ferrous phosphate, ferrous nitrate, ferrous sulfate, etc. When the surface to be coated is an iron surface, it may not be necessary to add any or as much ferrous or ferric ions since a portion of the iron surface is dissolved into the coating composition upon contact.

In a further embodiment, the coating compositions of the present invention will preferably contain fluoride ion in amounts of up to about 0.3% by weight. Fluoride ion concentrations in the range of from about 0.01 to about 1% by weight, and more often from about 0.03 to about 0.3% by weight can be included in the aqueous coating compositions of the invention. Water-soluble fluoride compounds can be utilized to introduce the fluoride ion into the coating compositions. Suitable fluoride compounds include alkali metal fluorides such as sodium fluoride, ammonium fluoride salts such as ammonium fluoride and ammonium bifluoride, other inorganic fluoride salts such as sodium silicofluoride, ammonium silicofluoride, hydrofluoric acid, hydrofluorosilicic acid and fluoroboric acid. In preferred embodiments, the fluoride ions are introduced into the composition through the Group IVB metal compound, for example, through the use of an alkali metal fluorozirconate compound.

The aqueous coating compositions of the present invention generally are utilized at a pH of between about 3.5 to 5.0 and more often, at a pH range of from about 4 to about 4.5. The pH of the solution can be adjusted by the addition of an alkali such as sodium hydroxide, potassium hydroxide or sodium carbonate to increase the pH, or an acid such as phosphoric acid to reduce the pH of the composition.

The coating compositions of the present invention can be applied to substrate surfaces in any known manner, for example, by immersion, dip coating, roll coating, spraying, and the like.

Moreover, it has been recognized through the present invention that pretreatment of metal substrates with compositions including metal ions do not provide consistent results. For example, treatment of steel substrates with coating compositions including fluorozirconate by spray application of the coating composition demonstrates a reduction in performance of the coating composition as the bath containing the coating composition ages. Similar reductions in performance are not seen, however, when the steel substrate is coated with the same coating compositions by immersion coating. Without wishing to be bound by any particular theory, it is believed that the bath containing the coating compositions for spray application continuously takes up oxygen from the ambient air. Such oxygen promotes oxidation of the steel substrate from the ferrous state to the ferric state. The zirconium dioxide does not deposit on the steel in the ferric state, but only on steel in the ferrous state. Accordingly, it is proposed through the present invention that improved universal coating compositions, and in particular compositions useful for spray application to steel substrates, can be achieved by further addition of a reducing agent in the form of a disaccharide to the coating composition. It has been discovered through the present invention that the use of such a disaccharide maintains the iron in the ferrous state.

Examples of useful disaccharides include lactose, sucrose, and mixtures thereof. The disaccharide is preferably present in the coating composition in an amount of 50 to 10,000 ppm.

The aqueous coating compositions of the present invention may be prepared by blending the various components described above in water. In a preferred embodiment, the coating compositions are prepared from a two-part system, wherein each part is separately prepared and subsequently blended into additional water. Generally, the mixture of the first part will contain water, the complex fluoride of a Group IVB metal, phosphoric acid, sodium hydroxide, one or more oxidizer-accelerators, and optionally, ammonium bifluoride. The second part or mixture comprises water, an oxidizer-accelerator, and the cyclic hydroxy compound(s). The two parts are then blended into water at desired concentrations, and the pH is adjusted with either sodium hydroxide or phosphoric acid to the desired pH of from 3.5 to 5.0.

In yet another embodiment, the metal surfaces which have been provided with a first coating in accordance with the present invention, may be subsequently contacted with a silane.

In one embodiment, the silane compounds are characterized by the formula $$A_{(4-x)}Si(B)_x \quad \text{(I)}$$

wherein A is a hydrolyzable group, x is 1, 2 or 3, and B is a monovalent organic group. The A groups are groups which hydrolyze in the presence of water and may include acetoxy groups, alkoxy groups containing up to 20 carbon atoms and chloro groups. In one preferred embodiment, x=1 and each A is an RO group such as represented by the formula $$(RO)_3SiB \quad \text{(II)}$$

wherein each R is independently an alkyl, aryl, aralkyl or cycloalkyl group containing less than 20 carbon atoms, more often up to about 5 carbon atoms. The number of hydrolyzable groups A present in the silane coupling agent of Formula II may be 1, 2 or 3 and is preferably 3 (i.e., x=1). Specific examples of RO groups include methoxy, ethoxy, propoxy, methylmethoxy, ethylmethoxy, phenoxy, etc.

The Group B in Formula I may be an alkyl or aryl group, or a functional group represented by the formula $$C_nH_{2nx}X \quad \text{(III)}$$

wherein n is from 0 to 20 and X is selected from the group consisting of amino, amido, hydroxy, alkoxy, halo, mercapto, carboxy, acyl, vinyl, allyl, styryl, epoxy, isocyanato, glycidoxy and acryloxy groups. The alkyl and aryl groups may contain up to about 10 carbon atoms. Alkyl groups containing from 1 to about 5 carbon atoms are particularly useful. In one embodiment, n is an integer from 0 to 10 and more often from 1 to about 5.

The amino groups may contain one or more nitrogen atoms and, thus, may be monoamino groups, diamino groups, triamino groups, etc. General examples of diamino silanes can be represented by the formula $$A_3SiR^4N(R^5)R^4N(R^5)_2 \quad \text{(IV)}$$

wherein A is as defined in Formula I, each $R^4$ is independently a divalent hydrocarbyl group containing from 1 to about 5 carbon atoms, and each $R^5$ is independently hydrogen or an alkyl or an aryl group containing up to about 10 carbon atoms. The divalent hydrocarbyl groups include methylene, ethylene, propylene, etc. Each $R^5$ is preferably hydrogen or a methyl or ethyl group.

The silanes which may contain amido groups include compositions represented by Formula I wherein the Group B may be represented by the formulae $$—R^4C(O)N(R^5)_2 \text{ and} \quad \text{(V)}$$

$$—R^{4-}N(R^5)C(O)N(R^5)_2 \quad \text{(VI)}$$

wherein each $R^4$ is independently a divalent hydrocarbyl group containing from 1 to 20 carbon atoms, more often from 1 to about 5 carbon atoms, and each $R^5$ is independently hydrogen or an alkyl or aryl group containing up to about 10 carbon atoms. Thus, the amido group may be an amide group or an ureido group. Generally, each $R^5$ in the formulae for the amido groups is hydrogen or an alkyl group containing from 1 to about 5 carbon atoms.

Examples of silanes useful in the present invention include N-(2-aminoethyl)-3-aminopropyltrimethoxysilane, 3-methacryloxypropyltrimethoxy-silane, 3-glycidoxypropyltrimethoxysilane, triacetoxyvinylsilane, tris(2-methoxyethoxy)-vinylsilane, 3-chloropropyltrimethoxysilane, 3-chloropropyltriethoxysilane, N-(aminoethylaminomethyl) phenyltrimethoxysilane, N-(2-aminoethyl)-3-aminopropyl tris(2-ethylhexoxy)silane, 3-aminopropyltrimethoxysilane, trimethoxysilylpropylenetriamine, β-(3,4-epoxycyclohexyl) ethyltrimethoxysilane, 3-mercaptopropyltrimethoxy silane, 3-mercaptotriethoxysilane, 3-mercaptopropylmethyidimethoxysilane, bis(2-hydroxyethyl)-3-aminopropyltrimethoxysilane, 1,3-divinyltetramethyidisilazane, vinyltrimethoxysilane, 3-isocyanatopropyidimethylethoxysilane, N-(3-acryloxy-2-hydroxypropyl)-3-aminopropyltriethoxysilane, methyltrimethoxysilane, ethyltrimethoxysilane, phenyltrimethoxysilane, phenyltriacetoxysilane, methyltrimethoxysilane, phenyltrimethoxysilane.

A number of organofunctional silanes are available, for example, from Union Carbide, Specialty Chemicals Division, Danbury, Conn. Examples of useful silanes available from Union Carbide are disclosed in U.S. Pat. No. 5,868,820, the disclosure of which is hereby incorporated herein by reference.

The silane may be applied to the coated metal surface as an aqueous mixture. The concentration of the silane in the mixture may range from about 0.01 to about 2% by weight. In one embodiment where the silane is to be applied and dried without a water rinse, a concentration of about 0.05 to about 0.15 is sufficient. If the silane treated panel is to be subsequently rinsed with water, silane concentrations of about 0.37 to about 1% or more are used.

The present invention will now be described in terms of a method of treating a metal substrate with the reactive organic conversion coating composition as described above. Prior to application of the coating composition, the surface of the metal substrate is cleaned to remove contaminants such as dirt, grease, oil or other residue therefrom. Such cleaning is well known in the art, and may typically involve cleaning with a detergent, preferably a water-based detergent, such as mild or strong alkaline cleaners. Examples of suitable alkaline cleaners include BASE Phase No-Phos or BASE Phase #6, both of which are available from PPG Industries, Pretreatment and Specialty Products. Such cleaning is generally followed and/or preceded by a water rinse.

Following cleaning and rinsing of the metal substrate, the thus-cleaned surface is then coated with the reactive organic conversion coating composition of the present invention.

This coating can be applied through any known technique, as described above. Preferably, the coating is applied by spray coating. The coating temperature is ambient, which may range from 15 to 30 degrees centigrade. Contact times of from about 5 seconds to about 5 minutes provide satisfactory coatings.

The concentration of the coating composition and the contact time should be sufficient to provide a coating thickness or weight which is sufficient to provide the desired corrosion resistance and adhesion of subsequently applied coatings. Generally thin coatings of about 50 to about 300 nanometers thickness and coating weights of from about 30 to about 60 mg/ft$^2$ are employed. The coatings deposited by the coating compositions of the present invention have a pleasing optical appearance.

Following application of the conversion coating, the coating is dried, and preferably rinsed, optionally, with water. As with the application of the coating composition, various contacting techniques may be used for rinsing, such as dipping, spraying and the like. Additionally, deionized water may be used as a final rinse for the coating.

In specific embodiments employing an additional rinse or a silane rinse, such rinse is provided between the water rinse and the final deionized water rinse.

In addition, the metal surface containing the coating composition as such may be contacted with an organic polymer resin to form a second organic coating. Examples of organic polymers which may be deposed over the first coating include ureaformaldehyde resins, polyethyleneamine, polyethanolamine, melamine-formaldehyde resins, epoxy based resins, etc.

The metal surfaces which have been provided with a first coating of the aqueous coating compositions of the present invention and, optionally, subsequently contacted with additional coating compositions to form a second coating over the first coating or, optionally, a seal coat, exhibit improved corrosion resistance and improved adhesion to siccative organic coatings. Siccative organic coatings which can be applied over the first or second coatings as top-coats include paints, enamels, varnishes, lacquers, synthetic resins, primers, etc. Such top-coats can be applied by conventional means such as by spraying, brushing, dipping, roller coating, or electrophoresis. After application of the siccative top-coat, the treated metal surface is dried either by exposure to the air or by means of a baking technique, depending on the nature of the siccative top-coat material.

The siccative organic coating compositions may be organic solvent based compositions. The organic solvents generally employed in the protective coating industry include benzene, toluene, xylene, mesitylene, ethylene dichloride, trichloroethylene, diisopropyl ether, aromatic petroleum spirits, turpentine, dipentene, amyl acetate, methyl isobutyl ketone, etc.

The siccative organic coating composition may also be a water based or emulsion paint such as synthetic latex paints derived from acrylic resins, polyvinyl alcohol resins, alkyd resins, melamine resins, epoxy resins, phenolic resins, etc., by emulsification thereof with water, as well as water-soluble paints derived from water-soluble alkyd resins, acrylic resins, and the like. The siccative organic coating may be a powder paint.

The siccative organic coating compositions may also contain conventional improving agents such as pigment extenders, anti-skinning agents, driers, gloss agents, color stabilizers, etc.

The siccative organic coating composition may be applied to the coated surface by techniques well known in the art for applying siccative organic coatings such as paints. For examples the coating may be applied by dipping, brushing, spraying, roller-coating, flow-coating, and by the electrophoretic process of painting metal surfaces. Often, the electrophoretic process is preferred because of the improved results which are obtained.

The following examples demonstrate the preparation of coating compositions of the present invention, as well as comparisons of such coatings with prior art compositions. Unless otherwise indicated in the examples and elsewhere in the specification and claims, all parts and percentages are by weight, temperatures are in degrees Centigrade, and pressures are at or near atmospheric pressure.

EXAMPLES

Example 1

This is a comparative example, relating to a coating composition prepared according to the teachings of Example 1 of U.S. Pat. No. 5,868,820. The reactive organic conversion coating bath contained per liter 18 grams of phosphoric acid, 4 g NaOH, 7 g NaClO3, 0.7 g ammonium bifluoride, and 3 g of mixed tannins (equal parts of quebracho and mimosa tannic acids), resulting in the following concentrations:

| COMPONENT | CONCENTRATION, ppm |
|---|---|
| Phosphoric Acid | 18,000 |
| NaOH | 4,000 |
| $NaClO_3$ | 700 |
| Ammonium Bifluoride | 7,000 |
| Tannin | 3,000 |

The conversion composition was applied by spray for 60 seconds to individual panels of cold rolled steel (CRS), electrogalvanized E-60 and 6061 aluminum. In contrast to the example in U.S. Pat. No. 5,868,820, the coating was applied at 25 degrees.

The panels thereafter were coated with the PPG powder coating PCT 50113 (available from PPG Industries, Inc.), cured, scribed, and subjected to salt fog corrosion testing according to ASTM B117. The test duration was 168 hours for CRS, 384 hours for electrogalvanized, and 1000 hours for aluminum. The paint losses in mm by delamination from taping are set forth in Table 1.

TABLE 1

| SUBSTRATE | PAINT LOSS-mm |
|---|---|
| Cold Rolled Steel | 8 |
| Electrogalvanized | 4.5 |
| Aluminum 6061 | 2.5 |

Example 2

This example also represents a comparative example, relating to a coating composition prepared according to the teachings of Example 3 of U.S. Pat. No. 5,868,820.

The reactive coating bath was prepared as in Example 1, but with $NaClO_3$ replaced by 7 grams of sodium meta-nitrobenzene sulfonate, resulting in concentrations as follows:

| COMPONENT | CONCENTRATION, ppm |
|---|---|
| Phosphoric Acid | 18,000 |
| NaOH | 4,000 |
| Sodium meta-nitrobenzene sulfonate | 7,000 |
| Ammonium Bifluoride | 700 |
| Tannin | 3,000 |

Panels were coated, painted and tested in a similar manner as in Example 1. In particular, the conversion coating was applied at 25 degrees, in contrast to Example 3 of U.S. Pat. No. 5,868,820. The results are set forth in Table 2A.

TABLE 2A

| SUBSTRATE | PAINT LOSS-mm |
|---|---|
| Cold Rolled Steel | 7 |
| Electrogalvanized E-60 | 4 |
| Aluminum 6061 | 2.5 |

A second set of panels was treated with the same organic conversion coating and then subjected to a zirconium rinse with a solution of fluorozirconic acid at a concentration of 175 ppm of Zr. The panels were painted, cured, scribed and tested as before, with the results set forth in Table 2B.

TABLE 2B

| SUBSTRATE | PAINT LOSS-mm |
|---|---|
| Cold Rolled Steel | 6 |
| Electrogalvanized E-60 | 4 |
| Aluminum 6061 | 1.5 |

As is apparent from a comparison of the results in Tables 2A and 2B, the zirconium rinse provides little, if any, benefit to adhesion.

Example 3

This example represents a comparative example, relating to a coating composition prepared according to the teachings of Example 1 of U.S. Pat. No. 4,338,140.

In particular, a bath was prepared to contain the following:

| COMPONENT | CONCENTRATION, ppm |
|---|---|
| $H_2TiF_6$ | 168 |
| $NH_4H_2PO_4$ | 143 |
| $H_2C_6H_6O_7$ | 46 |
| Tannic Acid | 30 |
| $NH_4HCO_3$ | 411 |
| $HNO_3$ | 588 |
| PH | 2.5 |

Panels were coated, painted and tested in a similar manner as in Example 1, with the results set forth in Table 3:

TABLE 3

| SUBSTRATE | PAINT LOSS - mm |
|---|---|
| Cold Rolled Steel | 12 |
| Hot Dip Galvanized G-90 | 2 |
| Electrogalvanized E-60 | 1 |

Example 4

This example represents a coating composition prepared according to the present invention.

A bath was made as in Example 1, and further including 175 ppm zirconium as fluorozirconic acid.

The organic conversion coating composition as prepared was applied to individual panels of cold rolled steel, hot dip galvanized G-90, and electrogalvanized E-60. The organic conversion coating composition was applied by spray at 25° C. for 60 seconds spray time.

The thus coated panels of cold rolled steel, hot dip galvanized G-90, and electrogalvanized E-60 were painted with a solvent based polyester white paint (PLOYCRON 1000 of PPG Industries, Inc.) Each of these panels was then cured, scribed and subjected to salt fog corrosion testing per ASTM B-117. The paint losses in mm by delamination from taping after 96 hours are set forth in Table 4.

TABLE 4

| SUBSTRATE | PAINT LOSS - mm |
|---|---|
| Cold Rolled Steel | 1 |
| Hot Dip Galvanized G-90 | 1 |
| Electrogalvanized E-60 | 0 |

A comparison of the results of Examples 1, 2 and 4 demonstrate the improvements seen through the present invention.

Example 5

The reactive organic conversion coating composition of Example 4 was prepared, with the zirconium replaced with 92 ppm of titanium as hexafluorotitanate. The reactive organic conversion coating composition as prepared was applied, subsequently painted, and tested as set forth in Example 4. The results are shown in Table 5.

TABLE 5

| SUBSTRATE | PAINT LOSS - mm |
|---|---|
| Cold Rolled Steel | 2 |
| Hot Dip Galvanized G-90 | 1 |
| Electrogalvanized E-60 | 1 |

As is apparent, titanium may be substituted for zirconium with similar improvements in performance.

Example 6

The reactive organic conversion coating composition of Example 4 was again prepared, with the amount of tannin decreased to a concentration of 70 ppm. The reactive organic conversion coating composition as prepared was applied, subsequently painted, and tested as set forth in Example 4. The results are shown in Table 6.

TABLE 6

| SUBSTRATE | PAINT LOSS - mm |
|---|---|
| Cold Rolled Steel | 12 |
| Hot Dip Galvanized G-90 | 5 |
| Electrogalvanized E-60 | 20 |

Example 7

The reactive organic conversion coating composition of Example 5 was prepared including hexafluorotitanate, with the amount of tannin decreased to a concentration of 70 ppm. The reactive organic conversion coating composition as prepared was applied, subsequently painted, and tested as set forth in Example 4. The results are shown in Table 7.

TABLE 7

| SUBSTRATE | PAINT LOSS - mm |
|---|---|
| Cold Rolled Steel | 15 |
| Hot Dip Galvanized G-90 | 6 |
| Electrogalvanized E-60 | 20 |

A comparison of the results of Examples 6 and 7 with the results of Examples 4 and 5 demonstrates that higher levels of tannin are required to provide the improved results seen through the present invention.

Example 8

The reactive organic conversion coating composition of Example 4 was prepared as set forth in Example 4. A first set of panels was coated with the bath as set forth in Example 4, and a second set of panels was coated in a similar manner, after a period of spraying of the bath for 45 minutes. Following this application, the two sets of panels were painted and tested as set forth in Example 4. The results are shown in Table 8.

TABLE 8

| | PAINT LOSS - mm | |
|---|---|---|
| SUBSTRATE | New Bath | Bath aged 45 minutes |
| Cold Rolled Steel | 1 | 7 |
| Hot Dip Galvanized G-90 | 1 | 1 |
| Electrogalvanized E-60 | 1 | 1 |

Example 9

Example 8 was repeated, with 6 grams per liter of lactose added to the bath prior to coating of the panels. Three sets of panels were coated with the bath, representing a new bath, after a period of spraying of the bath for 45 minutes, and after a period of spraying of the bath for 90 minutes, respectively. Following this application, the three sets of panels were painted and tested as set forth in Example 4. The results are shown in Table 9.

TABLE 9

| | PAINT LOSS - mm | | |
|---|---|---|---|
| SUBSTRATE | New Bath | Bath aged 45 minutes | Bath aged 90 minutes |
| Cold Rolled Steel | 1 | 1 | 1 |
| Hot Dip Galvanized G-90 | 1 | 1 | 1 |
| Electrogalvanized E-60 | 1 | 1 | 1 |

A comparison of the results of Examples 8 and 9 demonstrates that the addition of the disaccharide lactose has an affect on the age of the bath. In Example 8, the panels coated with the bath after aging for 45 minutes showed reduced adhesion as compared with a new bath. In Example 9, however, the panels coated with the bath after aging for 45 minutes and even 90 minutes showed no reduction in adhesion.

Example 10

The reactive organic conversion coating composition of Example 4 was prepared, with the hexafluorozirconate replaced with 175 ppm Zr as ammonium pentafluorozirconate (prepared from the decomposition of ammonium hexafluorozirconate). The reactive organic conversion coating composition as prepared was applied, subsequently painted, and tested as set forth in Example 4. The results are shown in Table 10.

TABLE 10

| SUBSTRATE | PAINT LOSS - mm |
|---|---|
| Cold Rolled Steel | 1 |
| Hot Dip Galvanized G-90 | 1 |
| Electrogalvanized E-60 | 0 |

A comparison of the results of Example 10 with those of Example 4 demonstrate that reactive organic conversion coatings prepared with pentafluorozirconates perform in a similar manner as those prepared with hexafluorozirconates.

Example 11

The reactive organic conversion coating composition of Example 4 was prepared and applied as set forth in Example 4. Following this application, the panels were subsequently coated with a 1% aqueous solution of a triethoxy ester of n-propyl gamma-amino silane (available commercially as Z-6011 from Dow Corning) for 30 seconds. The panels were then air dried, painted and tested as set forth in Example 4. The results are shown in Table 11.

TABLE 11

| SUBSTRATE | PAINT LOSS - mm |
|---|---|
| Cold Rolled Steel | 0 |
| Hot Dip Galvanized G-90 | 0 |
| Electrogalvanized E-60 | 0 |

While the invention has been described in terms of preferred embodiments, it is to be understood that various modifications thereof will become apparent to those skilled in the art upon reading the specification. Therefore, it is to be understood that the invention disclosed herein is intended to encompass such modifications as fall within the scope of the appended claims.

What is claimed is:

1. An aqueous composition for pretreating metal substrates comprising:

a) at least one hydroxy functional cyclic compound present in an amount of at least about 500 ppm, said hydroxy functional cyclic compound selected from the group consisting of polyhydroxy phenolic compounds and heterocyclic nitrogen-containing compounds having hydroxy functionality;

b) phosphate ions;

c) at least one oxidizer-accelerator;

d) at least one Group IVB metal compound capable of converting to a metal oxide upon application to the metal substrate;

e) at least one disaccharide; and f) water.

2. The composition of claim 1 wherein the hydroxy functional cyclic compound is selected from the group consisting of catechol, methylene-bridged poly (alkylphenols), coumaryl alcohol, coniferyl alcohol, hydroxyalkyl celluloses, lignin, tannin, sinapyl alcohol, and mixtures thereof.

3. The composition of claim 1 wherein the hydroxy functional cyclic compound is at least one tannin material.

4. The composition of claim 3 wherein the tannin material is selected from the group consisting of vegetable tannin, hydrolyzable tannin, condensable tannin, tannic acid, and mixtures thereof.

5. The composition of claim 4 wherein the tannin material is at least one of quebracho and mimosa tannins.

6. The composition of claim 1 wherein said hydroxy functional cyclic compound is present in an amount of about 500 ppm to about 2,500 ppm.

7. The composition of claim 1 wherein said phosphate ions are present in an amount of about 125 to about 300 ppm.

8. The composition of claim 1 wherein said oxidizer accelerator is present in an amount of about 10 to about 10,000 ppm.

9. The composition of claim 1 wherein said Group IVB metal compound is present in an amount of about 60 to about 600 ppm.

10. The composition of claim 1, having a pH within the range of about 3.5 to about 5.

11. The composition of claim 1 wherein said Group IVB metal compound is selected from the group consisting of hexafluorozirconic acid and hexafluorotitanic acid and their soluble salts.

12. The composition of claim 1, wherein said oxidizer-accelerator is selected from the group consisting of alkali metal chlorate, alkali metal bromate, alkali metal perchlorate, alkali metal chlorite, alkali metal nitrate, alkali metal nitrite, alkali metal perborate, ammonium chlorate, ammonium bromate, ammonium perchlorate, ammonium chlorite, ammonium nitrate, ammonium nitrite, ammonium perborate and mixtures thereof.

13. The composition of claim 1, wherein said oxidizer-accelerator is selected from the group consisting of halo-substituted benzene sulfonic acid, alkali metal salt of halo-substituted benzene sulfonic acid, ammonium salt of halo-substituted benzene sulfonic acid, nitro-substituted benzene sulfonic acid and ammonium salt of nitro-substituted benzene sulfonic acid.

14. The composition of claim 1, wherein said oxidizer-accelator comprises a mixture of an alkali metal salt of meta-nitrobenzene sulfonic acid and at least one alkali metal salt selected from the group consisting of alkali metal chlorate and alkali metal nitrate.

15. The composition of claim 1, wherein the disaccharide is selected from the group consisting of lactose and sucrose.

16. The composition of claim 1, wherein the disaccharide is present in an amount of 500 to 10,000 ppm.

17. A process for pretreating a metal substrate comprising contacting the substrate with an aqueous composition which comprises:

a) at least one hydroxy functional cyclic compound present in an amount of at least about 500 ppm, said hydroxy functional cyclic compound selected from the group consisting of hydroxy phenolic compounds and heterocyclic nitrogen-containing compounds having hydroxy functionality;

b) phosphate ions;

c) at least one oxidizer-accelerator;

d) at least one Group IVB metal compound capable of converting to a metal oxide upon application to the metal substrate;

e) at least one disaccharide; and f) water.

18. The process of claim 17 wherein the metal substrate is selected from the group consisting of cold rolled steel, steel surface-treated with any of zinc metal, zinc compounds and zinc alloys; aluminum; aluminum alloys; zinc-aluminum alloys; aluminum plated steel; and aluminum alloy plated steel.

19. The process of claim 17 wherein the metal substrate is a combination of two or more metal substrates assembled together.

20. The process of claim 17 wherein the metal substrate is contacted with the aqueous composition by immersion.

21. The process of claim 17 wherein the metal substrate is contacted with the aqueous composition by spray application.

22. The process of claim 17 wherein the at least one disaccharide is selected from the group consisting of lactose and sucrose.

23. The process of claim 17 wherein the aqueous composition is at ambient temperature.

24. The process of claim 17 further comprising the step of rinsing the metal substrate with an aqueous solution containing silane after contact with the aqueous composition.

* * * * *